US007533801B2

(12) United States Patent
Besnard

(10) Patent No.: US 7,533,801 B2
(45) **Date of Patent: *May 19, 2009**

(54) SECURITY DEVICE FOR THE TRANSPORTATION AND/OR STORAGE OF PRINTED ASSETS

(75) Inventor: Philippe Besnard, Griselles (FR)

(73) Assignee: Brink's France, Paris (FR)

( * ) Notice: Subject to any disclaimer, the term of this patent is extended or adjusted under 35 U.S.C. 154(b) by 498 days.

This patent is subject to a terminal disclaimer.

(21) Appl. No.: 11/241,977

(22) Filed: Oct. 4, 2005

(65) Prior Publication Data

US 2006/0230994 A1 Oct. 19, 2006

(30) Foreign Application Priority Data

Oct. 4, 2004 (FR) ..... 04 10456

(51) Int. Cl.
*G07D 11/00* (2006.01)

(52) U.S. Cl. ..... 235/379; 902/8; 902/9; 902/41; 109/25; 109/29

(58) Field of Classification Search ..... 902/8, 902/9, 41; 109/25, 29
See application file for complete search history.

(56) References Cited

U.S. PATENT DOCUMENTS

| | | | | |
|---|---|---|---|---|
| 2,035,498 | A * | 3/1936 | Navis et al. | 109/25 |
| 3,587,484 | A * | 6/1971 | Munton | 109/25 |
| 3,851,602 | A * | 12/1974 | Lamping | 109/23 |
| 4,607,579 | A * | 8/1986 | Stenild | 109/25 |
| 4,712,489 | A * | 12/1987 | Levavasseur | 109/25 |
| 4,852,502 | A * | 8/1989 | Klingberg et al. | 109/25 |
| 5,156,272 | A * | 10/1992 | Bouchard et al. | 109/29 |
| 5,598,793 | A * | 2/1997 | Lopez, Jr. | 109/25 |
| 5,732,638 | A * | 3/1998 | Van Lint | 109/29 |
| 6,536,348 | B1 * | 3/2003 | Gral | 109/25 |
| 6,564,726 | B1 * | 5/2003 | Lindskog | 109/25 |
| 6,568,336 | B2 * | 5/2003 | Van Lint | 109/29 |
| 6,712,011 | B2 * | 3/2004 | Fumanelli | 109/25 |
| 7,281,477 | B2 * | 10/2007 | Dyson et al. | 109/25 |
| 2002/0029728 | A1 * | 3/2002 | Walker | 109/25 |
| 2004/0154500 | A1 * | 8/2004 | Richard et al. | 109/25 |
| 2004/0216651 | A1 | 11/2004 | Besnard | |
| 2006/0121181 | A1 * | 6/2006 | Sleat et al. | 427/7 |
| 2007/0245927 | A1 * | 10/2007 | Besnard | 106/31.93 |

FOREIGN PATENT DOCUMENTS

| | | |
|---|---|---|
| EP | 1396601 | 3/2004 |
| FR | 2827001 | 1/2003 |
| FR | 2828232 | 2/2003 |
| GB | 1138104 | 12/1968 |
| WO | WO02095550 A2 * | 11/2002 |

* cited by examiner

*Primary Examiner*—Daniel A Hess
*Assistant Examiner*—Kristy A Haupt
(74) *Attorney, Agent, or Firm*—Young & Thompson

(57) ABSTRACT

A security device for the transportation and/or storage of assets includes a chamber for receiving these assets combined with at least one tank for a destructive product, the destructive product including chlorosulfonic acid, the tank suitable for the release of the destructive product under the direction of a control element, and the chamber adapted to expose the assets to gaseous decomposition products of the destructive product.

10 Claims, 1 Drawing Sheet

SECURITY DEVICE FOR THE TRANSPORTATION AND/OR STORAGE OF PRINTED ASSETS

The present invention relates to a security device for the transportation and/or storage of assets, in particular based on paper.

BACKGROUND OF THE INVENTION

It is known that the transportation and/or storage of assets of this type are currently carried out using chambers for receiving these assets, it being possible, for example, for these chambers to be formed by safes, armored cabinets, security cases or cash machine cassettes.

In order to discourage attacks against, for example, the transportation vehicles used and against the occupants of these, it is known to combine, with the chambers for receiving the assets, tanks of a staining product suitable for dispersing over the assets in these chambers, the operation of which is under the direction of control means.

However, this solution is not entirely satisfactory as there exist products which make it possible to remove stains from banknotes.

The Applicant has also described a security device which combines a product comprising chlorosulfonic acid for the dissolution of the printing inks for printed assets.

Furthermore, the Applicant has described such a device which combines an oxidation-reduction product.

However, the contact with these products has to be sufficiently complete to prevent any reuse of these banknotes. In this context, it is therefore advisable to provide for wetting of the whole of the assets, even when they are, as is frequently the case, gathered together in bundles.

These devices thus require an efficient system for dispersion of the product in order to provide for contact with the whole of the assets. It is also advisable to provide a sufficient amount of product in the device, which can present regulatory problems.

SUMMARY OF THE INVENTION

The aim of the invention is to provide a device which makes it possible to solve this problem.

To this end, a subject matter of the invention is a security device for the transportation and/or storage of assets comprising a chamber for receiving these assets in combination with at least one tank for a destructive product comprising chlorosulfonic acid, said tank being suitable for the release of the destructive product under the direction of control means and the chamber being proportioned so that the assets are exposed to the-gaseous decomposition product resulting from the destructive product.

The invention is based in particular on the finding that the effect of chlorosulfonic acid on paper assets, such as banknotes, occurs in several stages.

Thus, a banknote exposed to chlorosulfonic acid and then immersed in a water bath gives off particles of pigments and of metal. This phenomenon is denoted by the term of ink dissolution.

The reaction is very fast and is complete within a period of time of the order of a second.

It is assumed that the chlorosulfonic acid has a sulfonating effect on these organic compounds of the paper, rendering them thus soluble in the water and resulting in the disintegration of the dye. This reaction would mainly involve the binders but might also affect the other organic compounds present at the surface of the printed assets, in particular inks.

In the event of incomplete contact of the paper with the chlorosulfonic acid, a very different effect is observed.

For example, a banknote suspended above the acid or a banknote at the center of a bundle undergoes a structural transformation which is not very visible but visible in that the material becomes extremely fragile and brittle, crumbling away in the hand.

In view of the fact that the wetting capacity of chlorosulfonic acid is limited to a penetration of approximately 1 to 2 cm, it is assumed that this reaction involves not the chlorosulfonic acid itself but the decomposition gases generated by the latter.

This is because, in the presence of moisture, chlorosulfonic acid, which is liquid at ambient temperature and atmospheric pressure, decomposes according to the following reaction:

$$HClSO_3+H_2O \Rightarrow HCl+H_2SO_4$$

As HCl is gaseous under standard conditions, the reaction results in the formation of a volume of gas. In addition, the reaction generates energy, released in the form of heat. This heat will be contained within the pressurized chamber and will contribute to increasing the temperature.

In point of fact, the gaseous decomposition product has the advantage of being able to easily pass through the papers and of freely circulating in the chamber, thus providing intimate and effective contact with the whole of the assets.

On contact with the assets, it is assumed that the HCl reacts with the cellulose and results therein in the severing of the ether bonds between each glucose unit.

For its part, the sulfuric acid is assumed to dehydrate the cellulose by attacking the alcohol functional groups of the glucose units. Thus, the reaction releases water, which again decomposes the chlorosulfonic acid still available, with the release of heat.

In particular, in the presence of a large amount of assets, it is observed that the heat produced is no longer dissipated by the surroundings. This results in a large increase in the temperature.

In a third stage, a darkening of the banknotes is observed, in particular at their end.

This reaction is not observed when a single banknote is brought into contact with the chlorosulfonic acid. It requires either a larger mass of banknotes or the confinement of the assets in a closed volume. In both cases, observed temperatures of the order of 150 to 200° C. are achieved. The carbonization is the result of oxidation of the cellulose, presumably by the air, at these temperatures.

According to specific embodiments, the security device comprises one or more of the following characteristics:

the control means are suitable for triggering the operation of a pyrotechnic triggering device for dispersion of the product over the assets, in combination with the tank;

the paper assets are banknotes gathered together in bundles;

the device is an automated teller machine (ATM), a container for the transportation of money or a container for the storage of money;

the device furthermore comprises an amount of water capable of coming into contact with the chlorosulfonic acid to release heat and the gaseous decomposition product.

Finally, the invention relates to the use, in a security device for the transportation and/or storage of paper-based assets, of a gaseous decomposition product resulting from chlorosulfonic acid.

BRIEF DESCRIPTION OF THE SEVERAL VIEWS OF THE DRAWINGS

The invention will be better understood on reading the description which will follow, given solely by way of example and made with reference to the drawings, in which.

Specifically, a security device for the transportation and/or storage of paper assets has been represented in this FIGURE.

Figure 1:
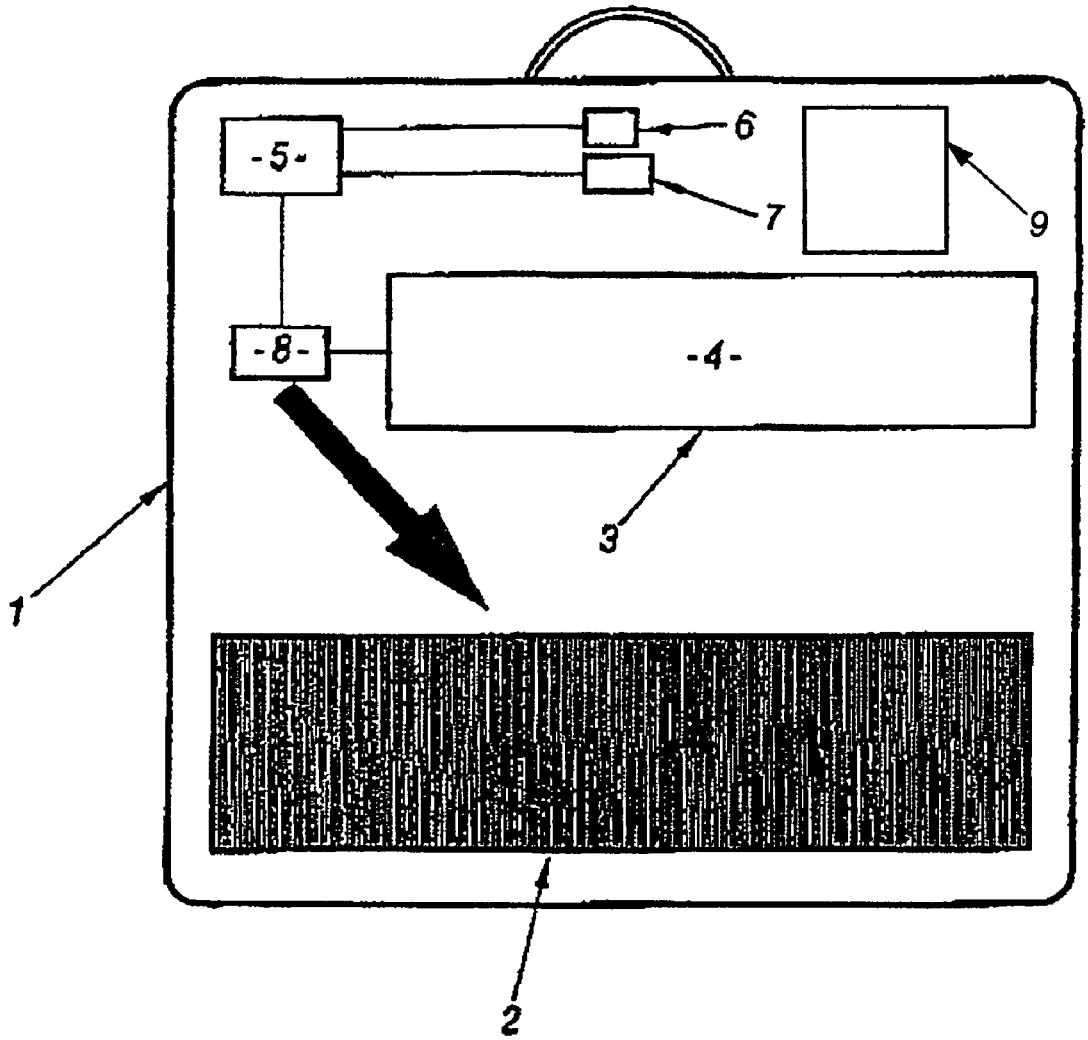
FIG. 1 shows a block diagram illustrating the general structure of a device according to the invention is represented.
Figure 2:
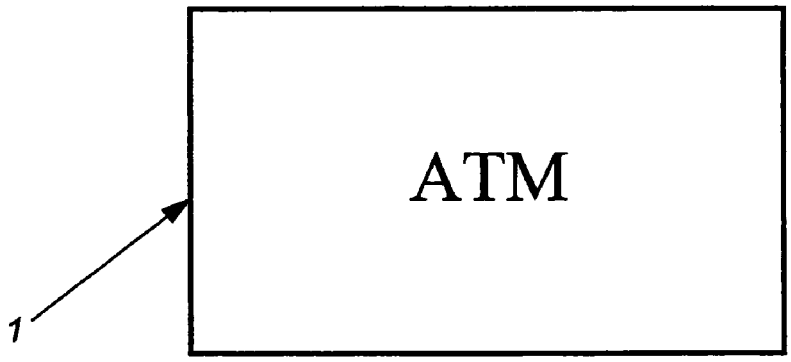
FIG. 2 shows the device as an automated teller machine (ATM).

This device comprises a chamber for receiving these assets, this chamber being denoted by the general reference 1 in FIGS. 1 and 2 and being provided, for example, in the form of a security case or of a cash machine cassette (see FIG. 1), the assets for their part being denoted by the general reference 2 and being provided, for example, in the form of banknotes or others, such as, for example, stock, checks, contracts, and the like.

As shown in FIG. 1, this chamber is combined with at least one tank 3 for a destructive product 4 capable of being released in the event of specific events, for example of an attempted break in, under the direction of control means denoted by the general reference 5.

These control means are connected to means for detecting a triggering event, such as, for example, a contact 6 for unauthorized opening of the case or also means 7 for monitoring the integrity of the latter, in order, in the event of an attempted break in, to allow the control means 5 to trigger the operation of means 8 for releasing the destructive product over the assets. These releasing means can comprise, for example, a pyrotechnic triggering device in combination with the tank.

Of course, other control means can be envisaged, such as, for example, means for detecting the reception or nonreception of a security signal, as is known.

The chamber can also be formed by a safe, an armored cabinet, an ATM (see FIG. 2), and the like, positioned in a vehicle, a building, and the like.

According to the invention, for the destruction of the paper assets present in the chamber, the product 4 has a composition such that, when the assets are brought into contact with the gaseous decomposition product, the paper assets are irreversibly transformed to become brittle and fragile, dispersing under the slightest handling. Thus, the paper assets are rendered unusable and therefore valueless.

If necessary, it may be advantageous to provide for humidification of the chamber, by means of a humidifier 9, prior to or simultaneously with the release of the chlorosulfonic acid, in order to ensure the complete decomposition thereof.

The time necessary to ensure the complete structural transformation of the paper assets is advantageously of the order of a few seconds.

It is understood that, in a security device such as that described here, when the chlorosulfonic acid is spread over the paper assets, contact with the assets is provided without the need for a high-performance dispersing device and the paper assets become brittle and friable, and for this reason unusable and therefore valueless.

What is claimed is:

1. A security device for the transportation and/or storage of assets, comprising:

a chamber for receiving assets;

a humidifier configured to humidify said chamber;

at least one tank;

a destructive product contained within the tank; and a control means for releasing said destructive product from the tank and into the chamber, wherein, said destructive product comprises chlorosulfonic acid, said tank is configured for the release of said destructive product under the direction of said control means to thereby create gaseous decomposition products from the destructive product within said chamber, said chamber is adapted to expose the assets to the gaseous decomposition products of the destructive product, and the chamber is humidified prior to or simultaneously with the release of the destructive product, the humidification configured to ensure complete decomposition of the destructive product.

2. The device as claimed in claim 1, wherein the control means are suitable for triggering the operation of a pyrotechnic triggering device for dispersion of the destructive product over the assets, in combination with the tank.

3. The device as claimed in claim 1, wherein the assets are banknotes gathered together in bundles.

4. The device as claimed in claim 1, which is an automated teller machine (ATM).

5. The device as claimed in claim 1, which is a container for the transportation of money.

6. The device as claimed in claim 1, which is a container for the storage of money.

7. A process for the transformation of transported and/or stored assets contained in a security device, in the event of an attempted break into the security device, comprising the steps of:

exposing the assets contained in the security device, upon the event of an attempted break, to gaseous decomposition products of chiorosulfonic acid, and humidifying, prior to or simultaneously with the exposing step, a chamber of the security device containing the assets.

8. The process according to claim 7, wherein said step of exposing the assets contained in the security device, upon the event of an attempted break, to gaseous decomposition products of chlorosulfonic acid, transforms a structure of said assets to become brittle and fragile so that said assets are rendered unusable as assets.

9. The process according to claim 7, wherein ether bonds between each glucose unit of cellulose of said assets are severed and wherein the cellulose of said assets is dehydrated.

10. A security device for banknotes, comprising:

a chamber for storing banknotes;

a humidifier for humidifying said chamber;

a destructive product comprising chlorosulfonic acid, the destructive product when decomposed creating gaseous decomposition products effective to render the banknotes within said chamber unusable as banknotes;

a tank containing the destructive product; and a control part for controllably releasing said destructive product from the tank into the chamber to i) create the gaseous decomposition products from the destructive product, and ii) expose the banknotes to the gaseous decomposition products so that the gaseous decomposition products destroy the banknotes within said chamber, wherein the chamber is humidified prior to or simultaneously with the release of the destructive product, the humidification sufficient to ensure decomposition of the destructive product.

* * * * *